US005632386A

United States Patent [19]

Gabhart

[11] Patent Number: 5,632,386

[45] Date of Patent: May 27, 1997

[54] TABLE TENNIS PADDLE AND BALL CADDY

[76] Inventor: Thomas S. Gabhart, 415 N. Geiger St., Huntingburg, Ind. 47542

[21] Appl. No.: 510,164

[22] Filed: Aug. 2, 1995

[51] Int. Cl.[6] ..... A47F 7/00

[52] U.S. Cl. ..... 211/85.7; 211/14; D6/552; 473/496

[58] Field of Search ..... 211/13, 14, 15; D6/552; 273/30, 76

[56] References Cited

U.S. PATENT DOCUMENTS

| | | | |
|---|---|---|---|
| D. 191,709 | 11/1961 | Shock | D33/3 |
| D. 246,340 | 11/1977 | Frank | D6/131 |
| D. 258,182 | 2/1981 | Thorne | D6/125 |
| 713,762 | 11/1902 | Haskell . | |
| 2,767,854 | 10/1956 | Barrett | 211/13 |
| 3,064,823 | 11/1962 | Shock | 211/15 |
| 3,842,979 | 10/1974 | Doelcher | 211/14 |
| 3,858,725 | 1/1975 | Pietrack et al. | D6/552 X |
| 4,125,192 | 11/1978 | Dayen | 211/14 |
| 4,211,406 | 7/1980 | Roesler et al. | 211/14 X |
| 5,368,172 | 11/1994 | Barringer | 211/13 |
| 5,472,189 | 12/1995 | Pfeiffer et al. | 273/30 |

*Primary Examiner*—Robert W. Gibson, Jr.

*Attorney, Agent, or Firm*—Jacobson, Price, Holman & Stern, PLLC

[57] ABSTRACT

An elongated body having front and rear sides and upper and lower margins as well as opposite end margins. The body defines endwise outwardly opening slots between the front and rear sides thereof and the slots also open upwardly and downwardly through the upper and lower margins, respectively. The slots include wide upper end portions and narrow lower end portions and downwardly receive the handles of a pair of inverted table tennis paddles therein with the handles projecting upwardly from the upper margin and the head panels of the paddles projecting downwardly from the lower margin. The opposite end slots are spaced apart longitudinally of the body and the latter defines a pair of upwardly opening ball receiving recesses spaced between the slots. A pair of forwardly and upwardly opening access slots are defined by the body in registry with and opening rearwardly into the recesses and through the front side of the holder. The access slots terminate downwardly a spaced distance below the lower extremities of the ball receiving recesses and the access slots are smaller in width than the ball receiving recesses and are of a size sufficiently wide to receive a person's finger therethrough, but sufficiently narrow to prevent forward movement of a table tennis ball therethrough.

10 Claims, 2 Drawing Sheets

TABLE TENNIS PADDLE AND BALL CADDY

BACKGROUND OF THE INVENTION

1. Field of the Invention

This invention relates to a holder for two table tennis paddles and two table tennis balls with the holder being of a configuration adapting it to be supported from one longitudinal margin of an associated table tennis table adjacent the net thereof and with the supported paddles and balls being supported from the holder facilitating great ease in removal of the paddles and balls therefrom as well as great ease placing paddles and balls in position to be supported from the holder.

2. Description of Related Art

Various different forms of holders for game balls, rackets, paddles and bats heretofore have been provided such as those disclosed in U.S. Pat. Nos. 713,762, 2,767,854, 3,064,823, 3,842,979, 4,125,192 and 5,368,172 as well as U.S. Design Pat. Nos. 191,709, 246,340 and 258,182. However, these previously known holders do not include the overall combination of structure and operational features incorporated in the instant invention.

SUMMARY OF THE INVENTION

An elongated body having front and rear sides and upper and lower margins as well as opposite end margins is provided and defines endwise outwardly opening slots between the front and rear sides thereof which also open upwardly and downwardly through the upper and lower margins. The slots include wide upper end portions and narrow lower end portions and are adapted to downwardly receive the handles of a pair of inverted table tennis paddles therein with the handles projecting upwardly from the upper margin and the head panels of the paddles projecting downwardly from the lower margin. In addition, the opposite end slots are spaced apart longitudinally of the body and the latter defines a pair of upwardly opening ball receiving recesses spaced between the slots. Further, a pair of forwardly and upwardly opening access slots are defined by the body in registry with and opening rearwardly into the recesses and through the front side of the holder, the access slots terminating downwardly a spaced distance below the lower extremities of the ball receiving recesses. The access slots are smaller in width than the ball receiving recesses and are of a size sufficiently wide to receive a person's finger therethrough, but are sufficiently narrow to prevent forward movement of a table tennis ball therethrough.

The main object of this invention is to provide a holder which may readily accommodate and removably support a pair of table tennis paddles as well as a plurality of table tennis balls.

Another object of this invention is to provide a holder in accordance with the preceding object and which may be readily semipermanently attached to one longitudinal side margin of an associated table tennis table adjacent the net thereof.

Still another object of this invention is to provide a holder from which a pair of table tennis paddles and a plurality of table tennis balls may be readily retrieved.

Another important object of this invention is to provide a holder which also may be mounted from any suitable vertical support surface.

Another important object of this invention is to provide a holder for table tennis paddles and balls and which will conveniently removably support table tennis paddles therefrom and protectively support table tennis balls therefrom against accidental injury.

A final object of this invention to be specifically enumerated herein is to provide a holder for table tennis paddles and balls and which will conform to conventional forms of manufacture, be of simple construction and easy to use so as to provide a device that will be economically feasible, long lasting and relatively trouble free in operation.

These together with other objects and advantageous which will be come subsequently apparent reside in the details of construction and operation as more fully hereinafter described and claimed, reference being had to the accompanying drawings forming a part hereof, wherein like numerals refer to like part throughout.

DESCRIPTION OF THE PREFERRED EMBODIMENT

Figure 1:
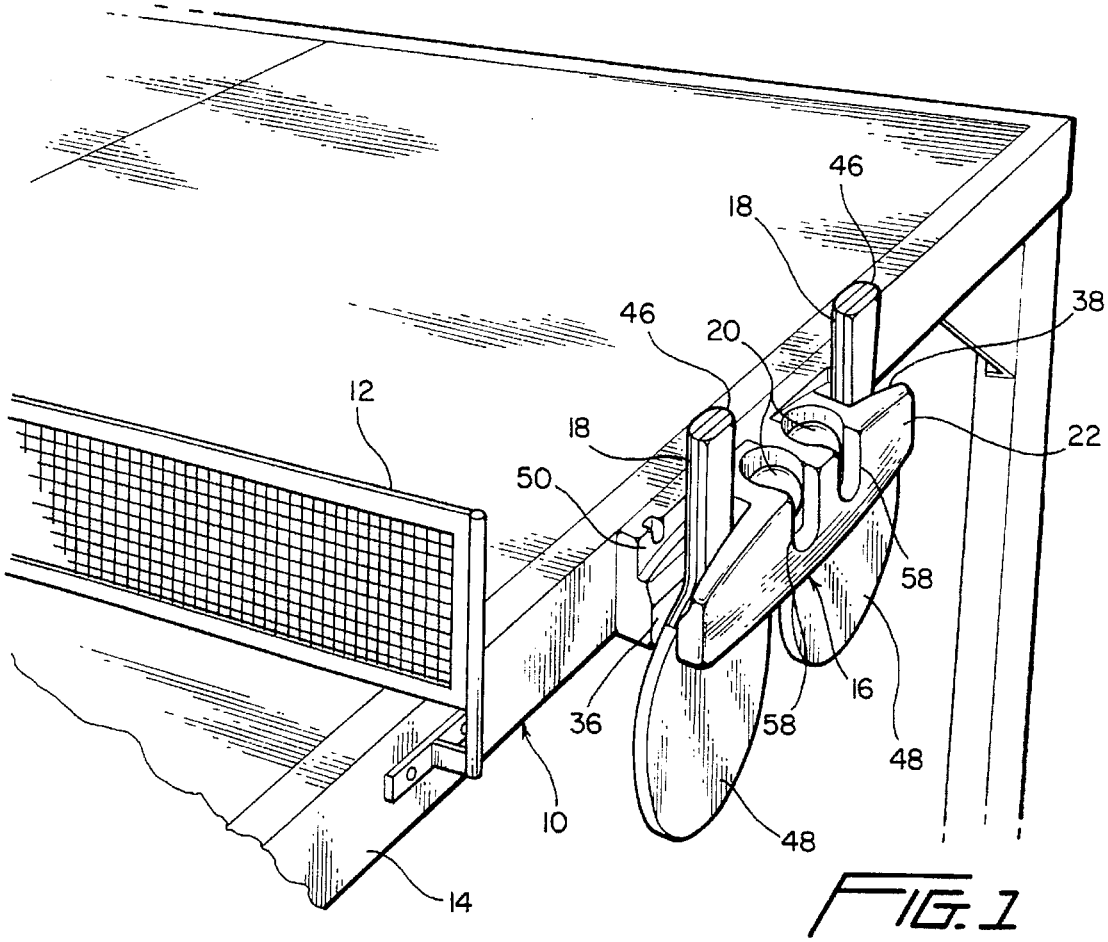
FIG. 1 is a fragmentary perspective view of one corner portion of a conventional table tennis table illustrating the paddle and ball caddy of the instant invention mounted from one side marginal portion of the table with a pair of paddles and balls supported from the caddy.

Referring now more specifically to the drawings the numeral 10 generally designates a typical form of table tennis table in FIG. 1 from which a center net assembly 12 is supported. The table 10 includes a first longitudinal margin 14 from which the caddy (referred to in general by the reference numeral 16) of the instant invention is removably supported. A pair of inverted table tennis paddles 18 and a pair of table tennis balls 20 are removably supported from the caddy 16.

Figure 2:
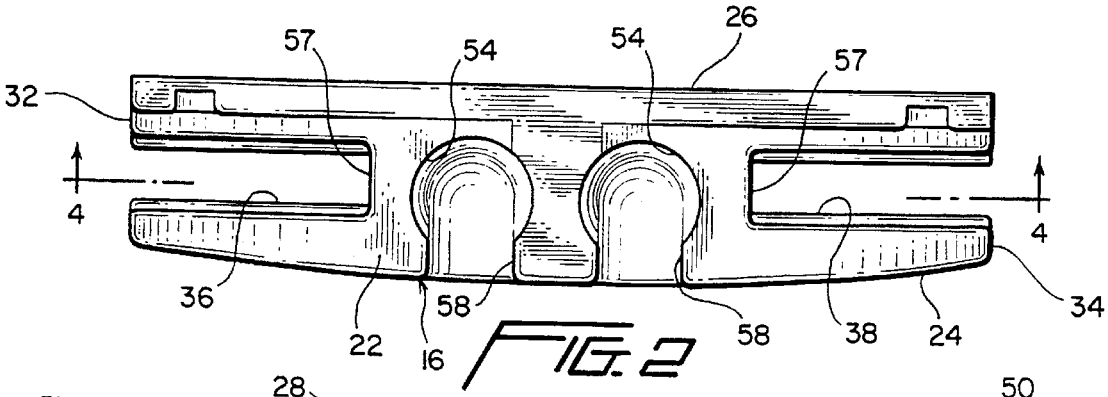
FIG. 2 is a top plan view of the caddy.
Figure 3:
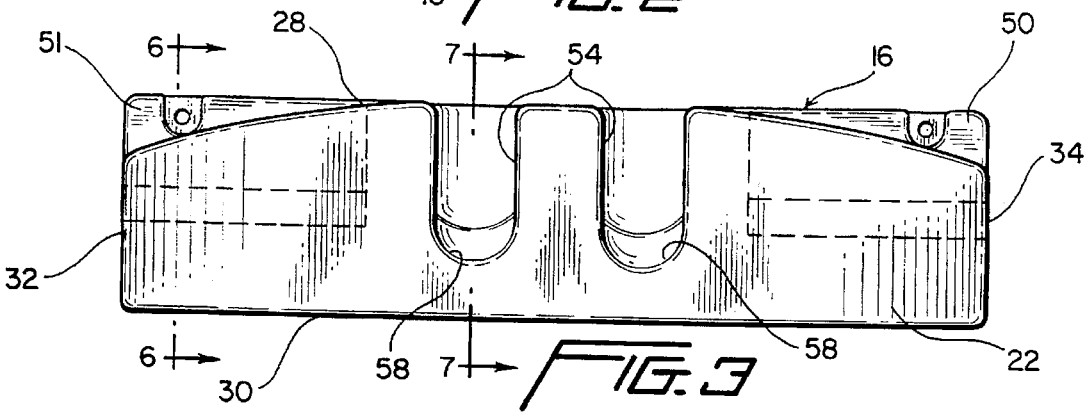
FIG. 3 is a front elevational view of the caddy.
Figure 4:
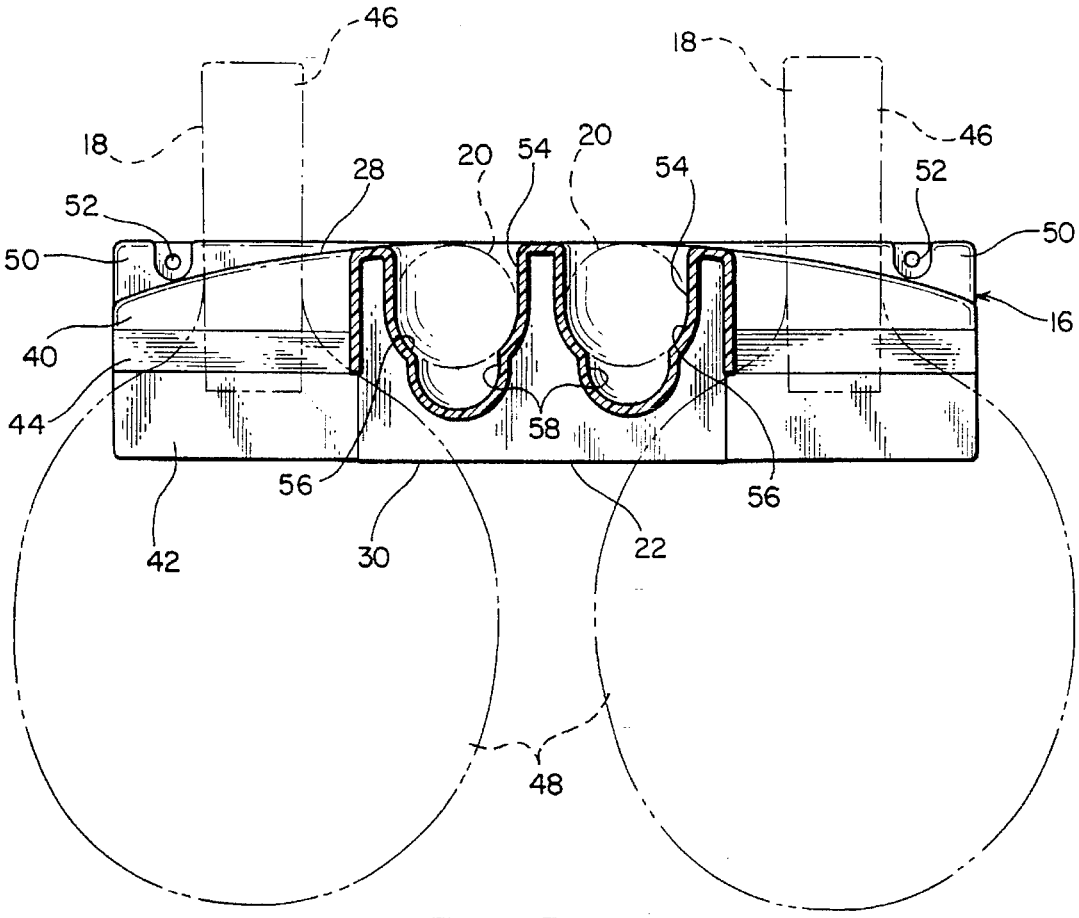
FIG. 4 is an enlarged fragmentary vertical sectional view taken substantially upon the plane indicated by the section line 4—4 of FIG. 2 and with a pair of supported paddles and a pair of supported balls being illustrated in phantom lines.

With reference now more specifically to FIGS. 2, 3 and 4, it may be seen that the caddy 16 comprises a one piece molded body 22 which opens downwardly and includes front and rear sides 24 and 26, upper and lower margins 28 and 30 and opposite end margins 32 and 34. The body 22 defines opposite end receiver slots 36 and 38 spaced apart longitudinally of the body 22 and opening endwise outwardly of corresponding ends thereof. In addition, the slots 36 and 38 open upwardly through the upper margin 28 and downwardly through the lower margin 30.

Figure 6:
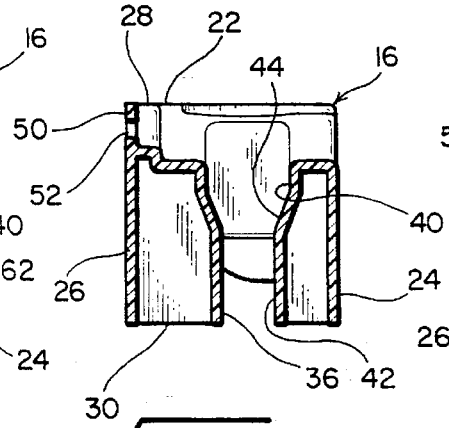
FIG. 6 is a vertical sectional view taken substantially upon the plane indicated by the section line 6—6 of FIG. 3.

The slots 36 and 38 each include wide (measured front-to-rear) upper portions 40, see FIG. 6, and narrow lower portions 42, the upper and lower portions 40 and 42 of each slot 36 and 38 being joined by a double bevelled intermediate portion 44.

Figure 5:
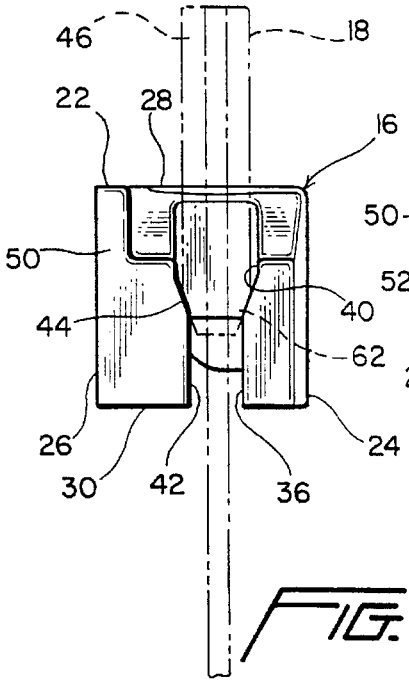
FIG. 5 is a left end elevational view of the assemblage illustrated in FIG. 4.

As may best be seen from FIGS. 1, 4 and 5, each of the slots 36 and 38 may removably support an inverted table tennis paddle 18 therefrom with the handle 46 of each paddle projecting upwardly above the upper margin 28 and the head panel 48 of each paddle 18 projecting downwardly below the lower margin 30.

Also, the opposite ends of the upper margin 28 includes elevated narrow rear portions 50 having apertures 52 formed therethrough by which threaded fasteners (not shown) or the like may be utilized to secure the body 22 to the longitudinal margin 14 of the table 10 adjacent the net assembly 12.

Figure 7:
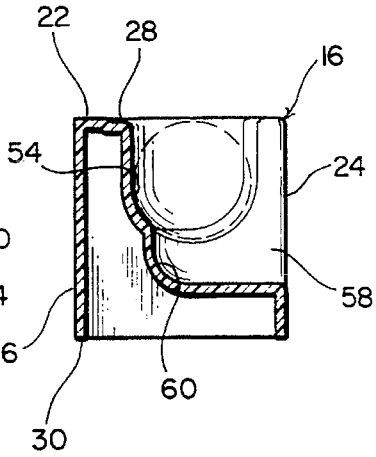
FIG. 7 is a vertical sectional view taken substantially upon the plane indicated by the section line 7—7 of FIG. 3.

In addition to the slots 36 and 38, the body 22 defines a pair of upwardly opening circular horizontal cross section recesses 54 spaced intermediate the closed ends 56 of the slots 36 and 38 and spaced longitudinally along the central portion of the body 22. The recesses 54 include rounded lower end portions 56 downwardly against the table tennis balls 20 are seatable and the front side 24 of the body 22 defines a pair of upwardly opening access slots 58 opening outwardly through the front side 24, upwardly through the upper margin 28 and inwardly into the recesses 54. The access slots 58 include closed lower ends 60 spaced slightly below the lower ends of the recesses 56 and extending inwardly therebeneath see FIG. 7. The access slots 58 are more narrow than the recesses 54 and are a width in which to receive the finger or thumb of a user. However, the slots 58 are sufficiently narrow to prevent forward movement of the balls 20 therethrough. Hence, the balls 20 may be upwardly displaced, only from the recesses 54.

From FIG. 4 of the drawings it will be seen that the typical paddle 18 includes a double bevelled upper end portion 62 on its handle 18, which double bevelled upper end portion 62 is downwardly seated in the intermediate portion 44 of the corresponding slot in order to support an inverted paddle 18 from the caddy or holder 16.

Inasmuch as the extreme upper margin 28 of the body 22 is substantially horizontal, the body 22 may be mounted to the longitudinal margin 14 of the table 10 with the extreme upper margin of the body 22 flush with the upper surface of the table 10. Of course, a pair of caddies 16 may be supported from the same longitudinally margin of the table 10 or from opposite longitudinal margins thereof, in the event four paddles 18 are to be supported from the table 10 for doubles play. Further, if two caddies 16 are mounted on the same table 10 and only two persons are to play, the paddles 18 from the second caddy 16 also will have to be removed and temporarily stored elsewhere during singles play.

It will be noted that the body 22 is structured in a manner enabling it to be readily molded of one piece construction from any suitable plastic material. However, it is to be understood that other materials and modes of manufacture also may be used, if desired.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A table tennis paddle holder including a horizontally elongated body having upstanding front and rear sides, upper and lower margins and opposite end margins, said body defining opposite end receiver slots formed therethrough, spaced apart longitudinally of said body and opening endwise outwardly through the corresponding end margins and also upwardly and downwardly through said upper and lower margins, respectively, said receiver slots including wide front-to-rear extending upper portions for receiving the handles of inverted table tennis paddle therein and narrow front-to-rear extending lower portions for receiving the head panels of inverted table tennis paddles therein, said receiver slots being adapted to downwardly or horizontally receive inverted table tennis paddles therein with said handles projecting upwardly through said upper margin and said head panels projecting downwardly through said lower margin.

2. The holder of claim 1 wherein said upper margin includes an elevated rear portion adjacent each end margin rearward of the corresponding end receiver slot and provided with a horizontal fastener receiving aperture therethrough by which said body may be anchored to a side edge of a table tennis table with said rear side clamped against said side edge.

3. The holder of claim 1 wherein said slots each include a front and rear downwardly bevelled midheight portion joining said upper and lower portions thereof and adapted to be downwardly abutted by the double bevelled upper end of a corresponding inverted table tennis paddle handle.

4. The holder of claim 1 wherein said body defines a pair of upwardly opening, circular horizontal cross section recesses opening upwardly through said upper margin at points spaced apart between said receiver slots, each of said recesses being of a diameter to loosely downwardly receive a table tennis ball therein, said body further defining a pair of upwardly opening access slots formed therein each opening forwardly through said front side, upwardly through said upper margin and rearwardly into a corresponding recess, said access slots each including lower portions terminating downwardly below and opening upwardly into the corresponding recess.

5. The holder of claim 4 wherein said slots each include a front and rear downwardly bevelled midheight portion joining said upper and lower portions thereof and adapted to be downwardly abutted by the double bevelled upper end of a corresponding inverted table tennis paddle handle.

6. The holder of claim 5 wherein said upper margin includes an elevated rear portion adjacent each end margin rearward of the corresponding end receiver slot and provided with a horizontal fastener receiving aperture therethrough by which said body may be anchored to a side edge of a table tennis table with said rear side clamped against said side edge.

7. A table tennis ball holder including a horizontally elongated body having upstanding front and rear sides, upper and lower margins and opposite end margins, said body defining a pair of upwardly opening, generally circular horizontal cross section recesses opening upwardly through said upper margin at points spaced apart between said end margins, each of said recesses being of a diameter to loosely downwardly receive a table tennis ball therein, said body further defining a pair of upwardly opening access slots formed therein each opening forwardly through said front side, upwardly through said upper margin and rearwardly into a corresponding recess, said access slots each including a closed lower portion terminating downwardly below and opening upwardly into the corresponding recess, said access slots each being of a horizontal transverse dimension less than the diameter of the corresponding recess and greater than the width of a thumb.

8. A table tennis paddle holder including a horizontal body having upper and lower margins, a first peripheral margin adapted to be abutted against and secured to an upstanding support surface and a further peripheral margin extending between and interconnecting the opposite ends of said first margin, said body defining at least one elongated receiver slot extending vertically therethrough and having a first closed end and a second open end opening endwise outwardly of said peripheral margin, said receiver slot including a wide upper portion for receiving the handle of an inverted table tennis paddle therein and a narrow lower portion for receiving the head panel of an inverted table tennis paddle therein, said slot further including a downwardly tapering double bevelled mid-height portion joining said upper and lower portions thereof and adapted to be downwardly abutted by the double bevelled table tennis paddle handle upper end.

9. The table tennis paddle holder of claim 8 wherein said body further includes an upwardly opening, circular horizontal cross section recess opening upwardly through said upper margin, said recess being of a diameter to loosely downwardly receive a table tennis ball therein, said body further defining an upwardly opening access slot formed therein opening, at one horizontal end, through said further peripheral margin and into said recess at the other horizontal end, said access slot also opening upwardly through said upper margin and including a lower portion terminating downwardly below and opening upwardly into said recess.

10. The table tennis paddle holder of claim 4 wherein said lower portions are closed, said access slots each being of a horizontal transverse dimension less than the diameter of the corresponding recess and greater than the width of a thumb.

* * * * *